US005136735A

United States Patent [19]

Zimmerman

[11] Patent Number: 5,136,735

[45] Date of Patent: Aug. 11, 1992

[54] IMMOBILE PATIENT SHOWER AND SKIN CARE UNIT

[76] Inventor: Phyllis E. Zimmerman, 13650 Fernridge Ave., Milwaukie, Oreg. 97222

[21] Appl. No.: 666,136

[22] Filed: Mar. 7, 1991

[51] Int. Cl.[5] ..... A47K 3/22

[52] U.S. Cl. ..... 4/597; 4/601; 4/604; 128/366

[58] Field of Search ..... 4/546, 547, 555, 556, 4/560, 570, 597, 601, 604; 128/366, 369, 30, 202.12, 365, 368, 402; 600/21

[56] References Cited

U.S. PATENT DOCUMENTS

| | | | |
|---|---|---|---|
| Re. 20,226 | 1/1937 | Drinker et al. | 128/30 |
| 1,059,314 | 4/1913 | Petter | 4/597 X |
| 1,643,528 | 9/1927 | Thurston | 128/366 |
| 2,308,630 | 1/1943 | Roy | 128/30 |
| 2,385,683 | 9/1945 | Burton | 128/30 X |
| 2,427,665 | 9/1947 | Emerson | 128/30 |
| 2,540,159 | 2/1951 | Antrim | 4/601 |
| 2,888,683 | 6/1959 | Medlock | 4/604 |
| 3,272,199 | 9/1966 | Matthews | 600/21 |
| 3,423,769 | 1/1969 | Cowley | 4/556 |
| 3,527,202 | 9/1970 | Donzelle | 128/369 |
| 3,613,127 | 10/1971 | Bond | 4/597 X |
| 3,616,467 | 11/1971 | Drain | 4/604 |
| 3,662,409 | 5/1972 | Johansson | 4/560 |
| 3,678,921 | 7/1972 | Brendgord et al. | 600/21 |
| 3,703,733 | 11/1972 | McLoughlin | 4/556 |
| 3,831,593 | 8/1974 | Ochoa | 128/369 |
| 4,055,863 | 11/1977 | Duval | 4/601 |
| 4,099,272 | 7/1978 | Sowder | 4/555 |
| 4,118,810 | 10/1978 | Brickhouse et al. | 4/556 |
| 4,425,672 | 1/1984 | Johnson | 4/596 |
| 4,432,104 | 2/1984 | Sasaki | 4/555 |
| 4,439,877 | 4/1984 | Houle | 4/596 |
| 4,796,312 | 1/1989 | Corlew | 4/555 |
| 4,859,345 | 8/1989 | Inagaki | 210/764 |
| 4,993,087 | 2/1991 | Roquebrune | 4/555 |

FOREIGN PATENT DOCUMENTS

| | | | |
|---|---|---|---|
| 17317 | 10/1980 | European Pat. Off. | 4/604 |
| 194625 | 9/1986 | European Pat. Off. | 4/570 |
| 3601064 | 7/1987 | Fed. Rep. of Germany | 4/555 |
| 779941 | 4/1935 | France | 128/369 |
| 453575 | 6/1968 | Switzerland | 600/21 |
| 1582900 | 1/9181 | United Kingdom | 4/555 |

*Primary Examiner*—Henry J. Recla
*Assistant Examiner*—Robert M. Fetsuga
*Attorney, Agent, or Firm*—Eugene D. Farley

[57] ABSTRACT

A shower and skin care unit for immobile patients. A case open at one end receives a shower-type gurney with the patient lying supine thereon with his head extending outwardly outside the open end of the case. Multiple shower heads deliver water and/or skin treating reagents. A closure releasably closes the open end of the case and positions beneath the patient's head a shapmpoo tray which drains into the case interior. A baffle molded on the interior of the closure below the shampoo tray also drains into the case interior. A trough on the case floor collects the waste water from the shower heads and delivers it to a suitably positioned case drain outlet.

14 Claims, 3 Drawing Sheets

IMMOBILE PATIENT SHOWER AND SKIN CARE UNIT

The invention relates to an immobile patient's shower and skin care unit of the class wherein the patient is subjected to a shower spray in a case while lying supine on a bath-type gurney.

BACKGROUND AND GENERAL STATEMENT OF THE INVENTION

In hospitals, nursing homes, various other institutions as well as in private homes there is need for a shower and skin care unit suitable for use in treating immobile patients. Such a unit is useful not only to give the patient a shower and shampoo. It is significantly useful also in the following procedures:

Wound irrigation
Antiseptic cleansing
Blood and body waste cleansing
Improved catheter care
Treatment of hyperthermia
Treatment of hypothermia
Treatment of burns
Treatment of hospital associated infections
Eye and ear irrigations
Treatment of chemical burns and many other procedures.

It is the general purpose of the present invention to provide a shower and skin care unit of reasonable cost which may be used efficiently as a shower and shampoo unit but which is versatile in that it may be employed with facility in the treatment of a wide variety of traumatic conditions.

It is a further object of the present invention to provide such a unit which is readily accessible, mobile, comfortable, safe in use, and easily disinfected between patients.

It is a particular object of the present invention to provide a combination shower and skin care unit which is adaptable for use with programmable, computerized, electromechanical controls.

Broadly stated, the immobile patient shower and skin care unit of my invention comprises an elongated case open at one end for receiving a shower-type gurney with the patient lying supine on the gurney with his head supported and extending outside the end of the case. Multiple shower heads deliver bath water and/or skin treating reagents to the patient as he lies enclosed in the case.

A closure releasably closes the open end of the case and positions beneath the patient's head a shampoo tray which drains into the case interior.

A baffle molded on the interior of the closure below the shampoo tray also drains into the case interior.

Trough means on the case floor collect the waste water from the shower heads and deliver it to a suitably positioned case drain outlet.

THE DRAWINGS

DESCRIPTION OF A PREFERRED EMBODIMENT OF THE INVENTION

Figure 1:
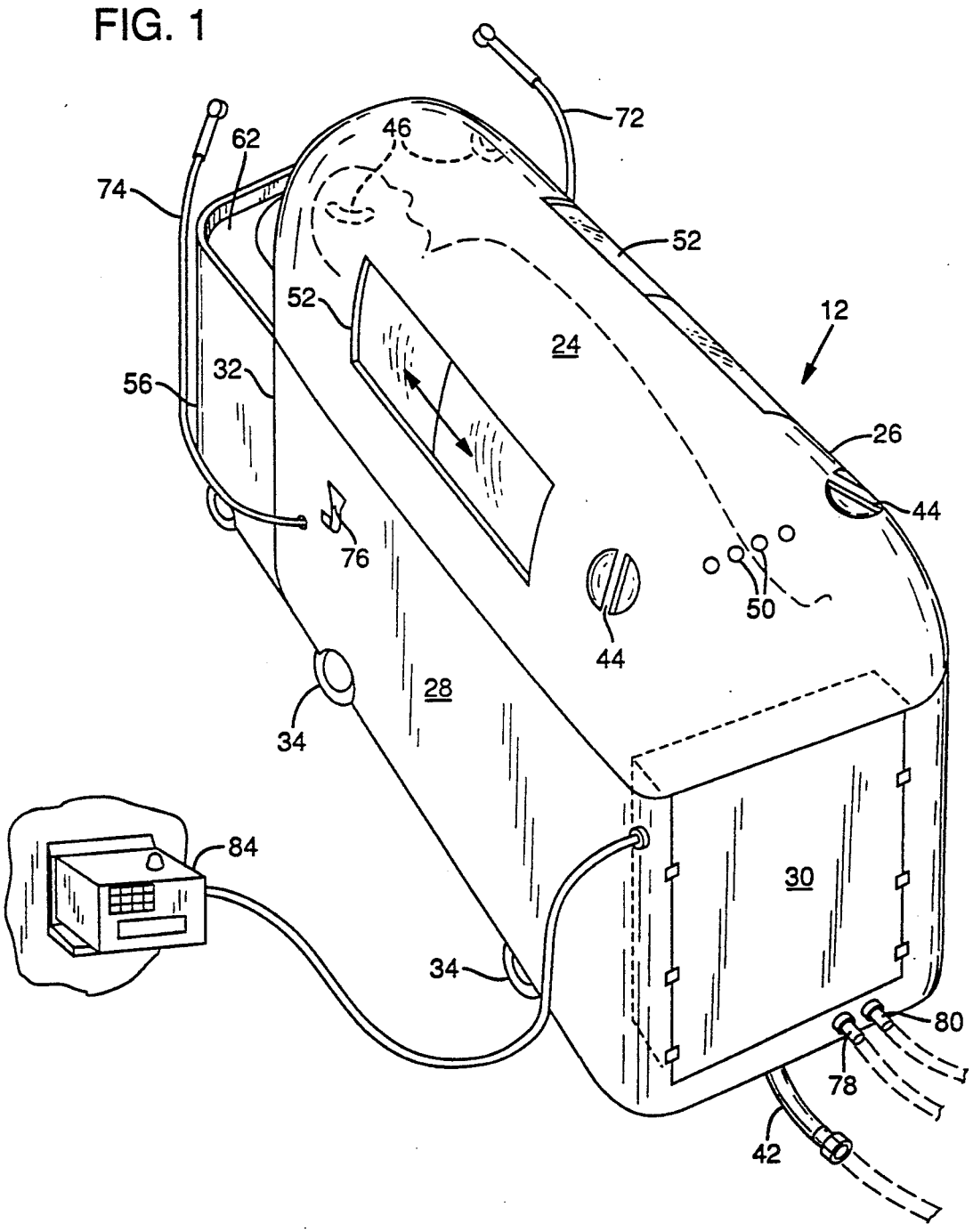
FIG. 1 is a top perspective view of the immobile patient shower and skin care unit of my invention in operative position.

As indicated above, the herein described shower and skin care unit comprises the combination of a hospital gurney indicated generally at 10 with a dispensing and shower unit, indicated generally at 12.

Gurney 10 is of the shower type used in hospitals for transporting patients to and from the shower bath. It comprises a wheeled support frame 14 mounting an elongated patient-support frame 16. The latter preferably has a reclining back. It also is provided with side rails 18 which act as slide boards for transferring the patient from his bed to and from the gurney.

Gurney frame 16 mounts a porous support of nylon webbing 20. Preferably, it also mounts soft cotton restraints for restraining the patient in position, if needed.

A blanket, not illustrated, covers the patient as he lies supine on the gurney.

Shower case 12 into which the gurney is adapted to be wheeled may be supplied in three sizes: adult, child and infant. It preferably is molded integrally from a suitable plastic material such as fiberglass. Its internal and external corners are rounded so as not to trap pathogens. Its internal surface preferably is coated with a corrosion resistant material such as polypropylene to resist the action of disinfectants and other corrosive liquids.

Viewed looking in the direction of its entrance, shower case 12 has a bottom 22, a top 24, a left side 26, a right side 28, a back end 30 and a front end 32.

Case bottom 22 mounts wheels 34 for ready mobility. The wheels preferably are of non-conductive material.

A ramp 36 leads the gurney into the interior of the case. The ramp preferably is detachable, as illustrated particularly in FIG. 4.

Figure 4:
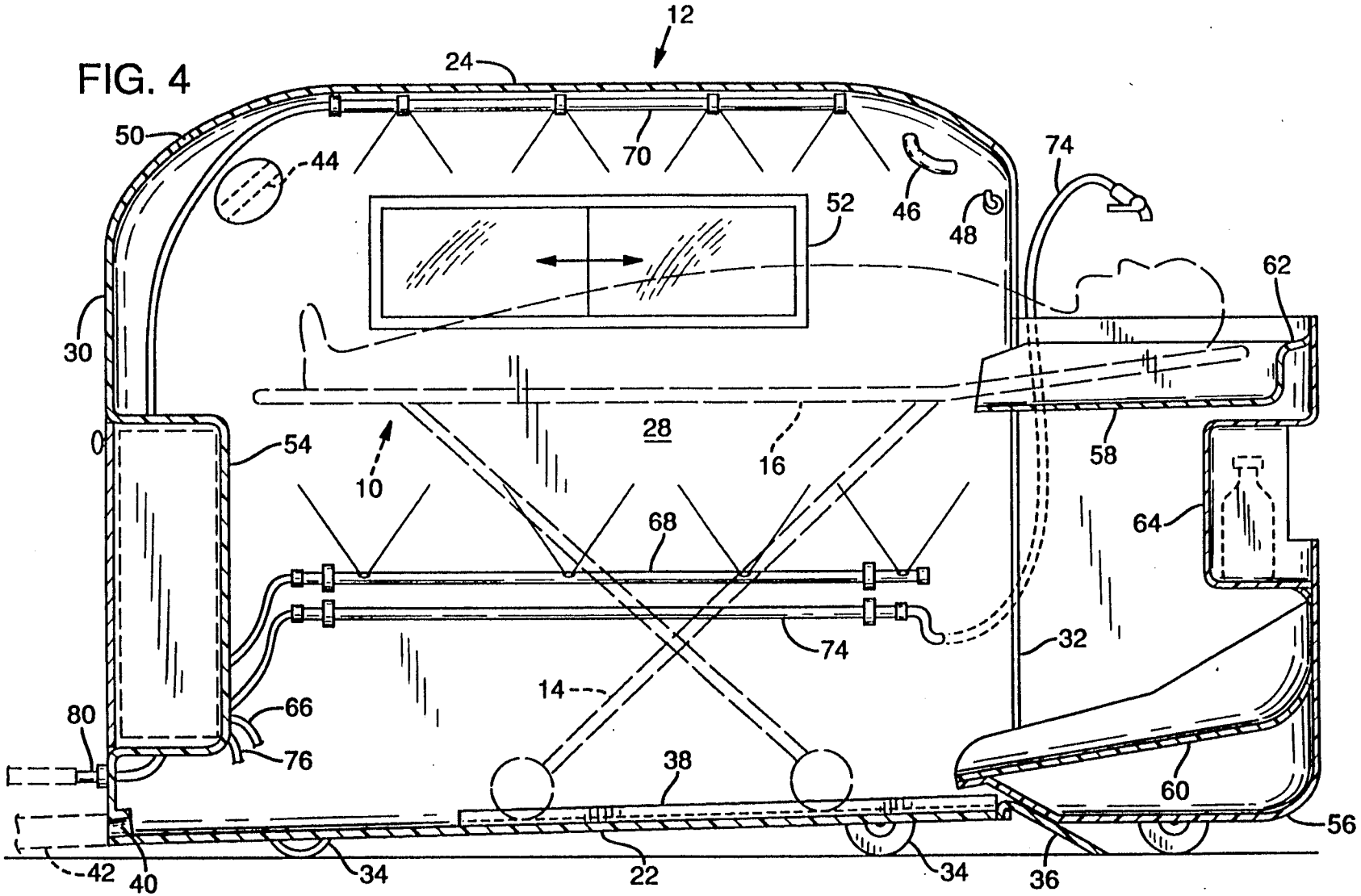
FIG. 4 is a longitudinal sectional view of the unit.

Ramp 36 leads the gurney onto guide means for guiding it the length of the case interior. This insures that the patient will not bump against the case sidewalls during the transit. As illustrated in FIG. 4, the guide means preferably comprises track means such as a pair of tracks 38 which communicate with the ramp and lead almost the entire length of the case interior.

Case bottom 22 either is formed with a central longitudinal trough, not illustrated, or is sloped gently downwardly toward the case back end 30 to form an integral trough which conducts water to the rear end of the case where it is vented through outlet 40 and discharge tube 42.

Case top 24 preferably is dome shaped, as illustrated. It mounts one or more exterior hand holds 44 by means of which the appliance is pulled from place to place. The hand holds preferably are recessed into the molded fiberglass case structure.

The upper portion of the case also mounts in its forward portion one or more interior hand grip means such as hand grips 46 it mounts further blanket advancing means such as clip 48.

Hand hold 46 is so located that the patient can lift himself sufficiently to shift his position, for example to one side or the other.

Clip 48 is designed to attach to the bottom or foot portion of the shower blanket. As the patient is wheeled into the gurney, the blanket is peeled off the patient as he enters the case. This affords him a desired modicum of privacy and prevents chilling. When he is ready to leave the case after his shower, the blanket is folded in accordion pleats and attached to the clip. Then as the he leaves, it is drawn over his body by the motion of the gurney, to cover him again.

Case top 24 also is provided with a plurality of vent holes 50 to permit the escape of steam.

Windows 52, either hinged or sliding, provide a closeable access to the patient so that he may be assisted as desirable or necessary to perform procedures during the bathing or treatment operations.

The top of the case preferably is opaque for privacy.

The back end 30 of the case mounts on its interior a plumbing distribution center and control means thereof, all housed in control box 54.

Figures 2, 3:
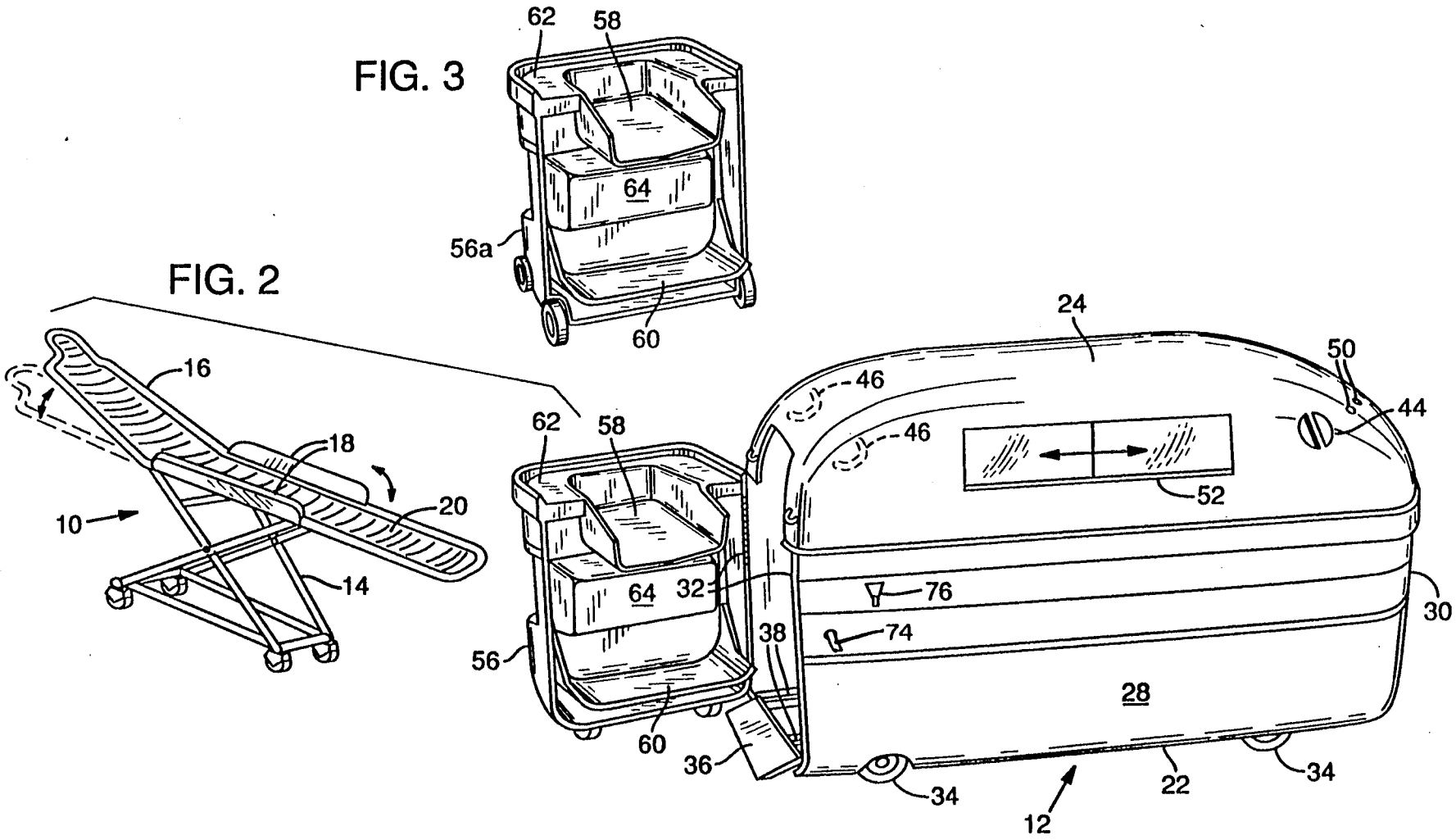
FIG. 2 is a side perspective view thereof, illustrated in position ready to receive a patient on a shower-type gurney.
FIG. 3 is a fragmentary, detail view of an alternate type of closure for use with the unit of FIGS. 1 and 2.

The front end 32 of the case is substantially open. It is fitted with a removable, wheeled closure 56 which fits across the open front end and seals it off when the shower unit is in operation. The closure may be hinged by suitable hinge means to a sidewall for opening and shutting, as illustrated in FIG. 2. Alternatively and preferably it may be a free-standing closure 56a, as illustrated in FIG. 3.

In either case, for speedy removal of the patient in the event of an emergency, the closure is not equipped with latches. Rather, it is secured releasably across the open end of the case by means of friction or magnetic type catches.

Closure 56 not only seals off the front end of the case during operation of the shower, it also provides the important function of providing means for giving the patient a shampoo during his sojourn in the unit.

To this end the wheeled closure mounts a dished shampoo bowl 58. This is positioned in such a manner that it lies beneath the projecting supported head of the patient as the rest of his body lies within the case.

The floor of the shampoo bowl slopes gently downwardly and its lip extends into the interior of the case. As a result, the bowl drains into the case.

Wheeled closure 56 also has baffle means such as a molded baffle 60. This has for its function returning waste water from the shower spray to the case for disposal together with the waste water resulting from the shampooing operation.

To this end the baffle bottom slopes downwardly toward the rear and is provided with an inwardly extending lip which extends into the case interior and discharges the waste liquid to the floor of the case.

Closure 56 is of further increased utility in the provision of a tray 62 on its upper surface and a receptacle 64 on its face surface. Both may be used for the support and/or storage of items useful during the showering or treating operation.

Shower heads with associated mounting means are arranged within the case in a manner calculated to produce the desired result. In the illustrated form of the invention there are three banks of fixed gentle, wide angle spray shower heads: left and right shower assemblies 66, 68, respectively, mounted on the inner side walls of the case; and upper shower assembly 70 mounted on the interior top surface of the case.

In addition, there are one or more portable or hand-held shower heads 72, 74 with flexible conduits, useful for various purposes such as, one for shampoo and one for antiseptic. When not in use, the hand-held shower heads are placed in their rest position in supports 76 in the exterior of the case.

Fixed shower assemblies 66, 68 and 70 and hand-held shower assemblies 72, 74 are connected through suitable conduit means and associated valving to the house hot water line 78 and house cold water line 80. If desired, solenoid operated dispensers and a water temperature control valve may be included in the piping for the introduction of various skin treating agents such as disinfectant, mild soap, skin softeners, antiseptic, and shampoo. All of these elements of the assembly are contained in control box 54.

Control of the system may be achieved in two ways: manual and automatic.

For manual control, manually operated valves may be employed for controlling the flows to the shower assemblies.

For automatic control, suitable electromechanical actuation may be employed in control box 54. It may be associated with a computer programmer 84 mounted on the wall or on an extendable arm adjacent the operator. Suitable programs then may be set up, for example:

Shower only
Shower and shampoo
Catheter care
Wound irrigation
Disinfectant cycle with security code
Tepid shower at selected water temperature.

OPERATION

The manner of operation of the immobile patient shower and skin care unit of my invention is as follows:

The patient is transferred from his bed to the shower gurney using gurney side boards as slide boards 18. He is wheeled to and into the shower unit using ramp 36 and tracks 38.

Closure 56 is put in place with shower tray 58 underlying the patient's head. The patient adjusts himself if necessary using hand grips 46. His shower blanket is removed automatically by the action of shower blanket grip 48 as he is wheeled into the unit. The nurse can make any desired adjustments using access openings 52.

The desired program is decided upon and set in motion, either manually or by the operation of the electromechanical units in case 54 controlled by computer programmer 84.

Fixed shower units 66, 68, 70 cleanse or treat the body of the patient. The attendant uses hand held shower unit 72, 74 to shampoo, or treat the patient's open skin or catheter care as ordered by the physician.

Water from the latter operation as well as from the showering operation is drained by shampoo tray 58 and baffle 60 into case 12 where it runs down the sloping floor toward the rear of the case and is discharged via discharge tube 42.

After showering, the patient is removed from the shower unit and dried, still on the shower gurney, wheeled back to his now rejuvenated bed.

Having thus described in detail a preferred embodiment of the present invention, it will be apparent to those skilled in the art that many physical changes may be made in the apparatus without altering the inventive concepts and principles embodied therein. The present embodiment is therefore to be considered in all respects as illustrative and not restrictive, the scope of the invention being indicated by the appended claims.

I claim:

1. An immobile patient shower and skin care unit comprising in combination with a shower gurney:

a) an elongated case of a length sufficient to receive the gurney and superimposed patient in supine position and with his head extending outside the case, the case having a top, bottom, two opposed sides, a substantially open front end and a substantially closed back end, b) a closure comprising shampoo stand means disposed across the open end of the case, adjustable between open and closed positions, c) at least one shower head means mounted on the case and directed against the patient as he lies on the gurney, d) conduit means connecting the shower head means with a source of water under pressure, e) control means in the conduit means for controlling the flow of water to the shower means, and f) drain means positioned for draining waste water from the case.

2. The immobile patient shower and skin care unit of claim 1 including guide means on the case floor for guiding the gurney as it enters and leaves the case.

3. The shower and skin care unit of claim 2 wherein the gurney is a wheeled gurney and the guide means comprises track means.

4. The immobile patient shower and skin care unit of claim 1 including hinge means hinging the closure to the case.

5. The immobile patient shower and skin care unit of claim 1 wherein the closure is free-standing.

6. The immobile patient shower and skin care unit of claim 1 including hand grip means on the top of the case adjacent the patient's arms for use by the patient in shifting his position on the gurney.

7. The immobile patient shower and skin care unit of claim 1 including access openings on the top or side of the case for use by an attendant in assisting the patient.

8. The immobile patient shower and skin care unit of claim 1 wherein the patient may be covered by a blanket as he lies on the gurney, entering the case, and including attaching means on the inside of the case adjacent the front end thereof for attachment to the leading end of the blanket for stripping the same off the patient as the gurney is moved into the case.

9. The immobile patient shower and skin care unit of claim 1 wherein the closure comprises shampoo stand means including a shampoo bowl positioned to underly the head of the patient and having an open end arranged for discharging shampoo waste water into the interior of the case.

10. The patient shower and skin care unit of claim 9 including baffle means mounted on the lower portion of the shampoo stand means below the shampoo bowl and having an open end draining into the interior of the case for intercepting shower water and directing it inwardly into the case.

11. The patient shower and skin care unit of claim 1 including a plurality of fixed shower heads and mounting means mounting the shower heads at predetermined positions inside the case.

12. The patient shower and skin care unit of claim 1 including at least one hand-held shower head, and the conduit means servicing it includes a flexible segment.

13. The patient shower and skin care unit of claim 1 including track means extending longitudinally of the case bottom, a shampoo bowl mounted on the inside of the closure and underlying the head of the patient and draining into the interior of the case, baffle means mounted on the lower portion of the closure and having an open end draining into the interior of the case for collecting shower spray and diverting it into the case interior, a plurality of fixed shower heads mounted in selected locations on the interior of the case, and at least one hand-held shower head, the conduit means including a flexible segment attached connecting the hand-held shower head to the source of water under pressure.

14. The patient shower and skin care unit of claim 1 wherein the control means comprise computer programmed electro-mechanical control means.

* * * * *